United States Patent [19]

Fryk

[11] Patent Number: 4,923,362

[45] Date of Patent: May 8, 1990

[54] BUCKET LEVELING SYSTEM WITH DUAL FLUID SUPPLY

[75] Inventor: Bruce K. Fryk, Waverly, Iowa

[73] Assignee: Deere & Company, Moline, Ill.

[21] Appl. No.: 202,286

[22] Filed: Jun. 6, 1988

[51] Int. Cl.[5] ..... E02F 3/43

[52] U.S. Cl. ..... 414/700; 91/170 R; 91/520; 414/708

[58] Field of Search ..... 414/699, 706, 708, 700; 91/520, 170 R

[56] References Cited

U.S. PATENT DOCUMENTS

| | | |
|---|---|---|
| 3,251,277 | 5/1966 | Stacey . |
| 3,563,137 | 2/1871 | Graber et al. . |
| 3,811,587 | 5/1974 | Seaberg . |
| 3,987,920 | 10/1976 | Parquet et al. . |
| 4,375,344 | 3/1983 | Baum et al. . |
| 4,408,518 | 10/1983 | Diel et al. . |
| 4,561,342 | 12/1985 | Calvert . |

FOREIGN PATENT DOCUMENTS

| | | |
|---|---|---|
| WO88/01600 | 3/1988 | PCT Int'l Appl. . |
| 1206607 | 9/1970 | United Kingdom . |
| 2028265 | 3/1980 | United Kingdom . |
| 1599283 | 9/1981 | United Kingdom . |

OTHER PUBLICATIONS

Cessna, "15 G.P.M. Inline Self-Leveling Valve", date unknown, 7 pages.

Design Engineering, "Electrohydraulics for Remote Control", Jun. 1981, pp. 57–63.

*Primary Examiner*—Robert J. Spar

*Assistant Examiner*—Donald W. Underwood

[57] ABSTRACT

A boom and bucket system for a loader includes a bucket leveling valve which maintains a desired orientation of the bucket as the boom is raised or lowered. A hydraulic circuit automatically and selectively supplies fluid for bucket leveling from boom cylinder return flow, from a pump, or from both in varying proportions.

16 Claims, 2 Drawing Sheets

BUCKET LEVELING SYSTEM WITH DUAL FLUID SUPPLY

BACKGROUND OF THE INVENTION

The present invention relates to a system for controlling the position of a bucket supported on a boom.

Load handling equipment and vehicles, such as industrial and agricultural loaders, often include leveling systems which control the orientation of the bucket while the boom is raised or lowered. In some hydraulic bucket leveling systems, fluid may be supplied to the bucket cylinder from the boom cylinder. In other leveling systems, fluid is supplied to the bucket cylinder from a pump or other pressure source. In systems which utilize pump output flow for bucket leveling, since pump flow is diverted from the boom cylinder to the bucket cylinder, either the pump capacity must be increased or else longer cycle times endured, than in a system without bucket leveling. Systems which rely entirely on fluid from the boom cylinder may be inaccurate due to temporary absences of boom return flow or variances in return flow resulting from changing load pressures or cycle rates. Systems which derive leveling flow from slave cylinders require that the slave cylinder displacements be carefully matched to the geometry and bucket cylinder displacements of the boom/bucket system.

SUMMARY OF THE INVENTION

An object of the present invention is to provide a boom/bucket system with a hydraulic system which can automatically and selectively utilize either boom cylinder return flow or pump flow (or a combination of both) for bucket leveling.

A further object of the present invention is to utilize pump provided flow for bucket leveling if boom cylinder return flow or pressure is insufficient.

These and other objects are achieved by the present invention which provides a hydraulic circuit for controlling fluid flow to the boom and bucket cylinders of a load handling system. The hydraulic circuit includes a separate manually operable directional control valve for extending and retracting the boom and bucket cylinders. A shuttle valve makes boom cylinder return flow available to an inlet of a bucket leveling valve. Fluid from a main pump is also.available to the bucket leveling valve inlet. Pressure responsive valves in the boom cylinder supply lines and between the pump and the bucket valve inlet operate to automatically and selectively supply the bucket leveling valve inlet with boom return flow, pump flow, or both in varying proportions. The bucket leveling valve is solenoid operated by an electronic position feedback control unit which is connected to sensors which sense the position of the boom and of the bucket.

DETAILED DESCRIPTION

Figure 1:
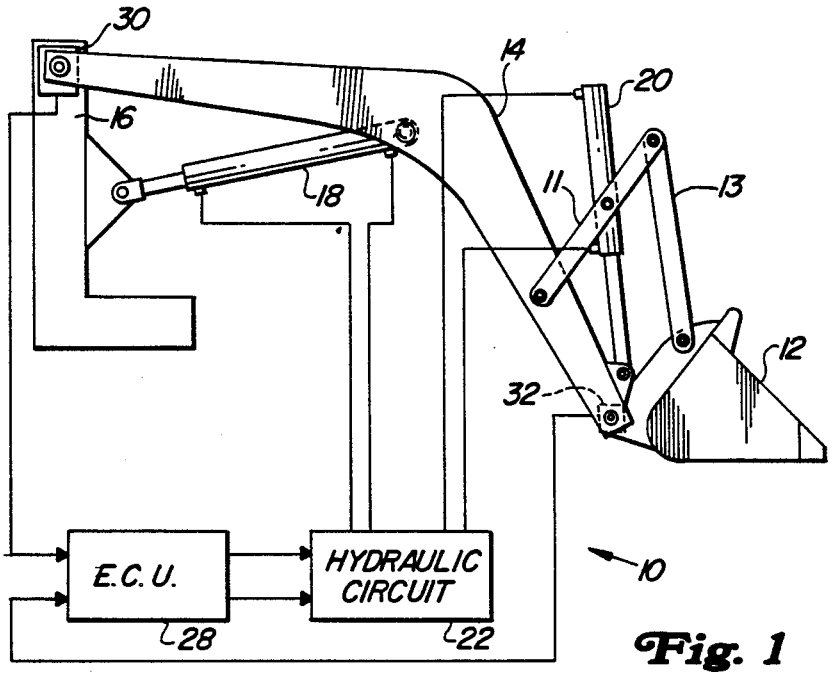
FIG. 1 is a simplified schematic diagram of a bucket leveling system including the hydraulic circuit of the present invention.

The bucket leveling system 10 includes a bucket 12 pivotally mounted on the end of a boom 14 which is pivoted on a frame member 16 of a vehicle or loader (not shown). The boom 14 is pivoted by a boom cylinder 18 and the bucket is pivoted by a bucket cylinder 20 connected to the boom and bucket by links 11 and 13. A hydraulic circuit 22 controls fluid flow to and from the cylinders 18 and 20. An electronic control unit (E.C.U.) 28 receives a position signal from a boom position sensor 30 and a bucket position signal from a bucket position sensor 32. Conventional rotary potentiometers could serve as the sensors 30 and 32. The control unit 28 generates valve control signals which are applied to the inputs of an electrically operated bucket leveling valve 90 in the hydraulic circuit 22. The control unit 28 could include a conventional analog electronic position feedback control circuit or this function could be performed by a digital control system including a suitably programmed microprocessor.

Figure 2:
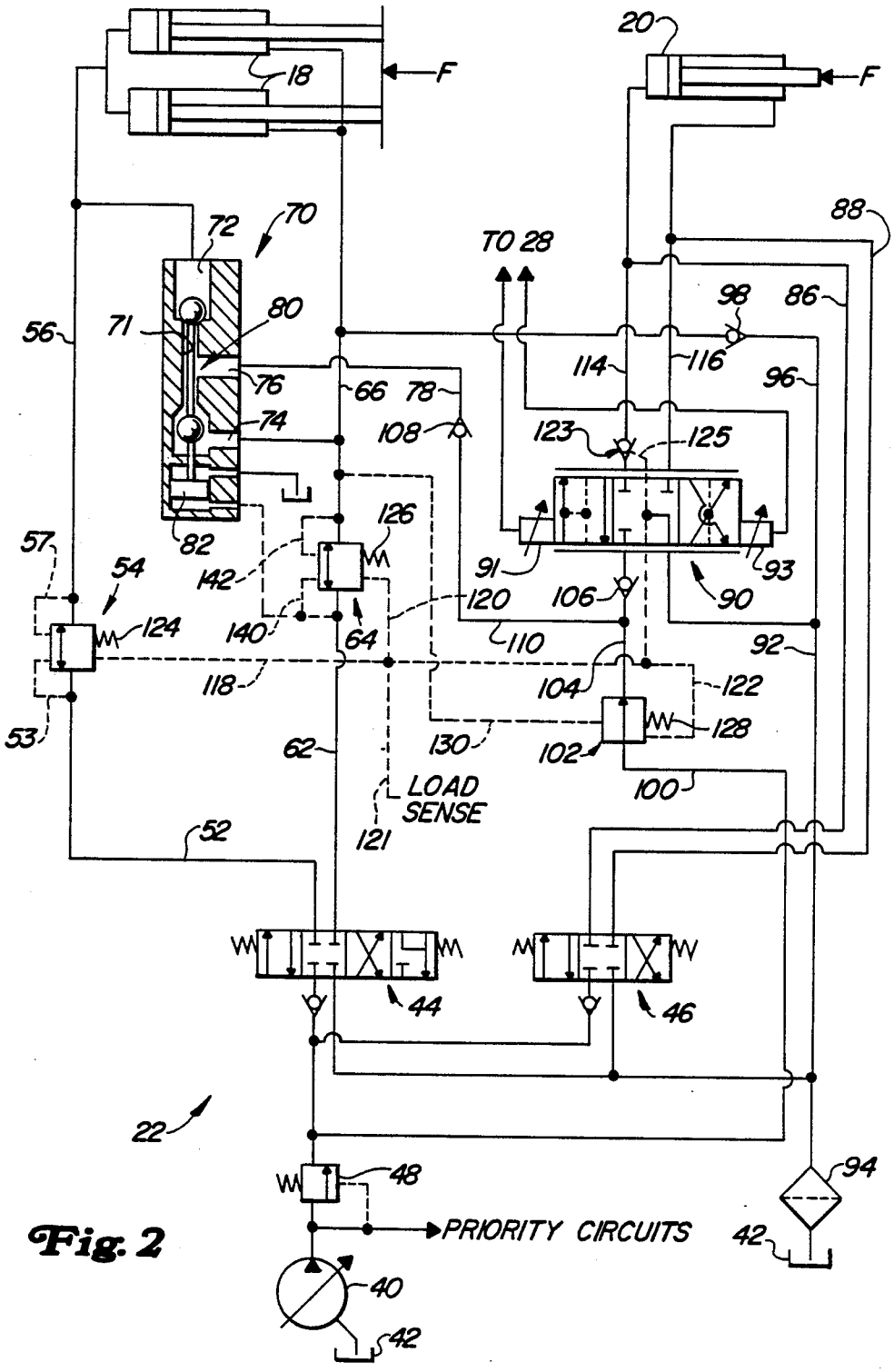
FIG. 2 is a hydraulic circuit diagram of the hydraulic circuit of the present invention.

Turning to FIG. 2, the hydraulic circuit 22 includes a pump 40 and a sump or reservior 42. The pump 40 may supply pressurized fluid to vehicle priority circuits (not shown) and supplies pressurized fluid to a spring centered, 4-way, 4-position, manually operated boom control valve 44 and to a spring centered, 4-way, 3-position operated bucket control valve 46, via priority valve 48.

Valve 44 includes a pump port, a sump port, a first load port connected to the head end of boom cylinder 18 via line 52, pressure operated valve 54 and line 56, and a second load port connected to the rod end of cylinders 18 via line 62, pressure operated valve 64 and line 66.

A shuttle valve 70 includes a bore 71 therein, a first port 72 connecting bore 71 to line 56, a second port 74 connecting bore 71 to line 66, and a third port 76 connected bore 71 to line 78. A ball-ended valve member 80 moves in bore 71 to block the one of ports 72, 74 with the highest pressure and to communicate with port 76 the one of ports 72, 74 with the lowest pressure. Valve 70 also includes a piston 82 exposed on one side of pressure in line 62 and on the other side to sump pressure. High pressure in line 62 moves piston 82 and shifts valve member 80 upwardly viewing the figure.

Bucket control valve 46 includes a pump port, a sump port, a first load port connected to the head end of bucket cylinder 20 via line 86, and a second load port connected to the rod end of bucket cylinder 20 via line 88.

Hydraulic circuit 22 also includes a 4-way, 3-position bucket leveling valve 90 operated by solenoids 91 and 93. Valve 90 includes a sump port connected to sump via line 92 and filter 94 and connected to line 66 via line 96 and check valve 98. Valve 90 also includes an inlet or pump port which can receive fluid from pump 40 via priority valve 48, line 100, pressure operated valve 102, line 104 and check valve 106. The inlet or pump port also receives fluid from line 78 via check valve 108 and line 110. Valve 90 also includes a first load port connected to the piston end of bucket cylinder 20 and to line 86 via line 114, and second load port connected to the rod end of bucket cylinder 20 and to line 88 via line 116. Load pressure sensing lines 118, 120 and 122 communicate pressure from the first load port of valve 90 (or from the second load port of valve 90 via an internal load sensing passage) to pressure operated valve 54, 64 and 102, respectively. A further load sense line 121 could be used if this system were to be used in a hydraulic system which included pumps or pressure and flow compensated control valves.

Pressure operated valve 54 is urged normally closed by spring 124 and the pressure in line 118, and is urged open by pressure in lines 52 and 56 via pilot lines 53 and 57. Pressure operated valve 64 is urged normally closed by spring 126 and by the pressure in line 120 and is urged open by the pressure in lines 62 and 66 acting through pilot lines 140, 142, respectively. Pressure operated valve 102 is urged open by spring 128 and the pressure in line 122. The pressure in line 130 closes valve 102 against the combined force of spring 128 and the pressure in line 122 opposes the pressure in line 130.

Bucket droop due to leakage may be reduced by the addition of a pilot operated check valve 123 in line 114. Pilot line 125 supplies pump pressure to open valve 123 when bucket cylinder 20 is to be retracted.

MODE OF OPERATION

When control valve 44 is shifted to extend the cylinder 18, the pressure in line 52 overcomes the force of spring 124 and opens valve 54, allowing hydraulic fluid to flow to the head end of cylinder 18. At the same time, the shuttle-check valve 70 moves to the position shown so that fluid from the rod end of cylinder 18 can flow to the pump port of bucket leveling valve 90 via line 66 ports 74 and 76, line 78, check valve 108, lines 110 and 104 and check valve 106. Fluid from the rod end of cylinder 18 may also flow back to sump via line 66, valve 64, line 62 and valve 44, if the pressure in line 66 overcomes the force of spring 126 and opens valve 64.

As the cylinder 18 extends (or retracts), to pivot boom 14, the position sensors 30 and 32, the E.C.U. 28 and the bucket leveling valve 90 cooperate to maintain the original orientation of bucket 12 with respect to frame 16.

For example, as cylinder 18 extends to lift boom 14, the valve 90 moves to its bucket-retraction position and the load pressure in line 116 is communicated via the pressure sensing lines to valves 54, 64 and 102. This load pressure tends to close valves 54 and 64 and tends to open valve 102. Fluid is then available to the rod end of cylinder 20 from pump 40 via valve 48, line 100, valve 102 and line 104, and/or from the rod end of cylinder 18 via line 66, valve 70, line 78, valve 108 and line 110.

The springs 128 and 126 are chosen so that valve 102 closes at a lower pressure differential than valve 64 so that valve 102 will close and block flow from pump 40 whenever there is sifficient return flow from cylinder 18 and sufficient pressure in line 66 to achieve the desired retraction of cylinder 20 via valve 90. If, for some reason, little or no oil is being returned from the rod end of boom cylinder 18, then valve 64 will close and valve 102 will remain open to provide fluid from pump 40 to valve 90.

The control valve 44 is preferably designed so that when the control valve 44 is moved to retract the boom cylinder 18, line 52 will be connected to sump before line 62 is connected to pump pressure. Gravity tends to lower the boom 14 and pressurize the head end of boom cylinder 18. This pressure acts through lines 56 and 57 to open valve 54, permitting return flow through line 52 and valve 44 so that the boom 14 may be lowered. At the same time, the expanding rod end of cylinder 18 receives fluid from the sump 42 via line 66, check valve 98, lines 96 and 92 and filter 94.

The sensors 30 and 32, the E.C.U. 28 and the bucket leveling valve 90 cooperate to extend cylinder 20 and maintain the desired orientation of bucket 12 with respect to frame 16 as the boom 14 lowers. For example, during boom lowering, the valve 90 is moved to its bucket cylinder extension position. The bucket load fluid pressure in line 114 is sensed and applied to valves 54, 64 and 102. At the same time, pressure is communicated through valve 44, line 62 and pilot line 140 to piston 82 in valve 70. Because the exposed area of piston 82 is at least 3 times greater than the area of the ball exposed to port 72, when the pressure in line 62 is approximately one-third of the pressure in the head end of cylinder 18, valve 70 shifts to a position wherein port 74 is closed and wherein port 72 is open to port 76 so that return flow from the head end of cylinder 18 can flow to valve 90 via valve 70, line 78, valve 108, lines 110, 104, and check valve 106. This return flow then becomes the primary source for the extension of bucket cylinder 20.

If the supply of fluid in line 100 exceeds what is required to level the bucket via valve 90, the pressure in line 62 will cause valve 64 to open so that the excess flow can flow to the rod end of boom cylinder 18. When pressure in the rod end of boom cylinder and in pilot line 130 increases above the combined force created by spring 128 and the pressure in line 122, valve 102 will close, forcing all of the flow from pump 40 into cylinder 18 rod side thereby decreasing cycle time. Return flow from line 56 in excess of that required for bucket cylinder extension will flow to sump via valve 54, line 52 and valve 44.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims. For example, the present invention could be used with the boom, bucket and cylinder arrangement such as described in U.S. Pat. No. 4,408,518 by exchanging connections to the solenoids 91 and 93 so that the boom and bucket cylinders would extend together and retract together. Also, the bucket position sensor could be located in a more protected location such as between the bucket cylinder housing and link 11, provided that the E.C.U. be modified to derive the boom-bucket relationship from the relationship between cylinder 20 and link 11.

I claim:

1. In a control system for a boom pivoted with respect to a frame by a boom motor and a bucket pivoted on the boom by a bucket motor, the control system including a pump, a reservoir, a control valve for controlling fluid communication between the pump, reservoir and boom motor, a circuit means coupled to the boom motor, the bucket motor, the pump and the reservoir for controlling fluid communication between the pump, the reservoir, the boom motor and the bucket motor, and leveling means coupled to the boom, the bucket and the circuit means and cooperating therewith for maintaining a desired orientation of the bucket, the improvement wherein:

the circuit means comprises a leveling valve having outlets coupled to the bucket motor, a sump inlet coupled to the reservoir and a supply inlet, and fluid supply means coupled to the boom motor, to the pump and to the supply inlet for automatically selectively supplying the supply inlet with fluid displaced from the boom motor and/or with fluid directly from the pump.

2. The control system of claim 1, wherein:
the fluid supply means selectively supplies fluid to the supply inlet during both extension and retraction of the boom motor.

3. The control system of claim 1, wherein:
the fluid supply means comprises pressure responsive means for increasing communication between the pump and the supply inlet in response to an increase in a load pressure supplied to the bucket motor.

4. The control system of claim 1, wherein the circuit means comprises:
a return line for communicating fluid from the boom motor to the control valve;
a branch line communicated with the supply inlet of the leveling valve;
means for communicating the return line with the branch line;
a first pressure responsive valve in the return line between the control valve and the means for communicating;
a supply line communicating the pump directly with the supply inlet of the leveling valve;
a second pressure responsive valve in the supply line; and
load pressure sense means for communicating pressure from an outlet of the leveling valve to the first and second pressure responsive valves, the first pressure responsive valve closing and the second pressure responsive valve opening in response to an increase in leveling valve outlet pressure.

5. The control system of claim 4, wherein the first pressure responsive valve comprises:
a pair of valve ports, each communicating with a separate portion of the return line;
a valve member movable to control communication between the valve ports;
a resilient member biased to urge the valve member toward a position closing communication between the valve ports;
a first pilot exposed to fluid pressure in the return line and operable to move the valve member toward its open position; and
a second pilot exposed to fluid pressure from the load pressure sense means and operable to move the valve member to its closed position.

6. The control system of claim 4, wherein the second pressure responsive valve comprises:
a pair of valve ports, each communicating with a separate portion of the supply line;
a valve member movable to control communication between the valve ports;
a resilient member biased to normally hold the valve member in an open position communicating the valve ports with each other;
a first pilot exposed to fluid pressure in the return line and operable to move the valve member against the bias of the resilient member and to a closed position; and
a second pilot exposed to fluid pressure from the load pressure sense means and operable to oppose the operation of the first pilot.

7. The control system of claim 6, wherein:
the first pilot is exposed to fluid pressure in the return line at a position between the boom motor and the first pressure responsive valve.

8. The control system of claim 4, wherein the circuit means comprises:
a shuttle valve having a housing defining a first port communicated with a rod end of the boom motor, a second port communicated with a piston end of the boom motor, an outlet communicated with the branch line and a shuttle valve member movable in the housing to open communication between the outlet and the port with the lowest fluid pressure therein and to close communication between the outlet and the other port.

9. The control system of claim 1, wherein the circuit means comprises:
a first line communicating a rod end of the boom motor with the control valve;
a first pressure responsive valve in the first line;
a second line communicating a head end of the boom motor with the control valve;
a second pressure responsive valve in the second line;
a branch line communicated with the supply inlet of the leveling valve;
a shuttle valve having a first inlet communicated to the rod end of the boom motor, a second inlet communicated to a head end of the boom motor, an outlet communicated with the branch line and a shuttle valve member for closing the most highly pressurized one of its inlets and for opening communication between its outlet and the other of its inlets;
a supply line communicating the pump with supply inlet of the leveling valve;
a third pressure responsive valve in the supply line between the pump and the branch line; and
load pressure sense means for communicating pressure from an outlet of the leveling valve to the first, second and third pressure responsive valves, the first and second pressure responsive valves closing in response to an increase in leveling valve outlet pressure, the third pressure responsive valve opening in response to an increase in leveling valve outlet pressure.

10. The control system of claim 9, wherein the shuttle valve comprises:
a pressure responsive member engageable with the shuttle valve member and responsive to fluid pressure in the first line to move the shuttle valve member to a position closing the first inlet and communicating the second inlet with the outlet.

11. The control system of claim 10, wherein:
the shuttle valve member has a first pressure responsive area exposed to fluid pressure from the first line between the boom motor and the first pressure responsive valve and a second pressure responsive area exposed to fluid pressure from the second line, the pressure responsive member having a third pressure responsive area exposed to fluid pressure in the first line between the control valve and the first presure responsive valve, the third area being larger than the first area.

12. The control system of claim 9, wherein the first pressure responsive valve comprises:
a pair of valve ports, each communicating with a separate portion of the first line;
a valve member movable to control communication between the valve ports;
a resilient member biased to urge the valve member toward a position closing communication between the valve ports;

a first pilot exposed to fluid pressure in the first line and operable to move the valve member toward its open position; and a second pilot exposed to fluid pressure from the load pressure sense means and operable to move the valve member to its closed position.

13. The control system of claim 9, wherein the third pressure responsive valve comprises:

a pair of valve ports, each communicating with a separate portion of the supply line;

a valve member movable to control communication between the valve ports;

a resilient member biased to normally hold the valve member in an open position communicating the valve ports with each other.

a first pilot exposed to fluid pressure in the return line and operable to move the valve member against the bias of the resilient member and to a closed position; and a second pilot exposed to fluid pressure from the load pressure sense means and operable to oppose the operation of the first pilot.

14. The control system of claim 13, wherein:

the first pilot of the third pressure responsive valve is exposed to fluid pressure in the first line at a position between the boom motor and the first pressure responsive valve.

15. A control system for a boom pivoted with respect to a frame by a boom cylinder and a bucket pivoted with respect to the boom by a bucket cylinder, the control system comprising:

a fluid pump;

a fluid reservoir;

a control valve having a pump port connected to the pump, a reservoir port connected to the reservoir, a pair of boom ports connected to the boom cylinder and a control valve member for controlling fluid communication between the pump, reservoir and boom cylinder;

a leveling valve having an outlet connected to the bucket cylinder, an inlet and a leveling valve member for controlling fluid communication between an inlet thereof and the bucket cylinder;

fluid supply means coupled to the boom cylinder, the pump and to the leveling valve inlet for selectively and alternatively supplying to the leveling valve inlet fluid displaced from the boom cylinder and with fluid direct from the pump; and leveling means coupled to the boom, the bucket and to the leveling valve for cooperating with the leveling valve to maintain a desired orientation of the bucket with respect to the frame.

16. The control system of claim 15, wherein:

the fluid supply means operates during both extension and retraction of the boom cylinder.

* * * * *